US008677759B2

(12) United States Patent
Kaleeswaran et al.

(10) Patent No.: US 8,677,759 B2
(45) Date of Patent: Mar. 25, 2014

(54) RING COOLING FOR A COMBUSTION LINER AND RELATED METHOD

(75) Inventors: Karthick Kaleeswaran, Bangalore Karnataka (IN); Rao Ganesh Pejawar, Bangalore Karnataka (IN); Sonal Bhojani, Vadodara Gujarat (IN)

(73) Assignee: General Electric Company, Schenectady, NY (US)

( * ) Notice: Subject to any disclaimer, the term of this patent is extended or adjusted under 35 U.S.C. 154(b) by 1005 days.

(21) Appl. No.: 12/349,173

(22) Filed: Jan. 6, 2009

(65) Prior Publication Data

US 2010/0170256 A1 Jul. 8, 2010

(51) Int. Cl.
*F23R 3/04* (2006.01)
*F23R 3/46* (2006.01)

(52) U.S. Cl.
USPC ..... 60/772; 60/752; 60/754; 60/755

(58) Field of Classification Search
USPC ..... 60/754, 755, 757, 758, 760, 39.37, 752, 60/772
See application file for complete search history.

(56) References Cited

U.S. PATENT DOCUMENTS

| | | | | |
|---|---|---|---|---|
| 3,420,058 | A * | 1/1969 | Howald et al. | 60/757 |
| 3,978,662 | A * | 9/1976 | DuBell et al. | 60/757 |
| 4,084,371 | A * | 4/1978 | Howald | 60/755 |
| 4,622,821 | A | 11/1986 | Madden | |
| 4,653,279 | A | 3/1987 | Reynolds | |
| 4,700,544 | A | 10/1987 | Fucci | |
| 4,719,748 | A * | 1/1988 | Davis et al. | 60/760 |
| 4,872,312 | A | 10/1989 | Iizuka et al. | |
| 4,875,339 | A | 10/1989 | Rasmussen et al. | |
| 4,903,477 | A * | 2/1990 | Butt | 60/39.37 |
| 5,223,320 | A * | 6/1993 | Richardson | 60/755 |
| 5,687,572 | A | 11/1997 | Schrantz et al. | |
| 5,784,876 | A * | 7/1998 | Alkabie | 60/752 |
| 6,193,502 | B1 * | 2/2001 | Sudarev et al. | 60/758 |
| 6,484,505 | B1 | 11/2002 | Brown et al. | |
| 6,708,499 | B2 * | 3/2004 | Pidcock et al. | 60/752 |
| 7,096,668 | B2 * | 8/2006 | Martling et al. | 60/757 |
| 7,134,287 | B2 * | 11/2006 | Belsom et al. | 60/800 |
| 2002/0189260 | A1 * | 12/2002 | David et al. | 60/752 |
| 2005/0268613 | A1 | 12/2005 | Intile et al. | |
| 2006/0168967 | A1 * | 8/2006 | Simons et al. | 60/752 |
| 2007/0193274 | A1 * | 8/2007 | Belsom | 60/773 |
| 2007/0245741 | A1 * | 10/2007 | Johnson et al. | 60/752 |
| 2008/0155987 | A1 * | 7/2008 | Amond et al. | 60/752 |
| 2010/0071382 | A1 * | 3/2010 | Liang | 60/752 |

FOREIGN PATENT DOCUMENTS

| | | | |
|---|---|---|---|
| CN | 1052730 | A | 7/1991 |

OTHER PUBLICATIONS

U.S. Appl. No. 11/907,322, filed Oct. 11, 2007.
Office Action and Search Report from CN Application No. 201010003837.3 dated May 27, 2013.

* cited by examiner

*Primary Examiner* — Ted Kim
(74) *Attorney, Agent, or Firm* — Nixon & Vanderhye P.C.

(57) ABSTRACT

A gas turbine combustor includes a liner having a forward end and an aft end; a flow sleeve surrounding the liner, the flow sleeve also having forward and aft ends, the aft end of the flow sleeve supporting an annular ring formed with a plurality of cooling bores and extending through the flow sleeve, at least some of the plurality of cooling bores formed at an acute angle relative to a longitudinal axis of the liner.

16 Claims, 2 Drawing Sheets

RING COOLING FOR A COMBUSTION LINER AND RELATED METHOD

BACKGROUND OF THE INVENTION

This invention relates generally to gas turbine combustion technology and, more specifically, to a flow sleeve and combustor liner arrangement configured to redirect cooling air toward a particular target area.

In a gas turbine combustion system, the combustion chamber casing contains a liner which is typically constructed in a generally cylindrical configuration, with a closed forward end and an open aft end. Fuel is ordinarily introduced into the liner via one or more fuel nozzles at the closed end, while combustion air is admitted through circular rows of apertures or air mixing holes spaced axially along the liner. These gas turbine combustion liners usually operate at extremely high temperatures and depend to a large extent on incoming compressor air for cooling purposes. More specifically, combustor liners are typically impingement cooled by flowing compressor discharge air through a series of cooling apertures provided in a flow sleeve surrounding the liner.

In some instances, cooling inserts or thimbles have been located in the flow sleeve cooling apertures to bring the cooling air jets into close proximity with the liner surface, or even more specifically, with known hot spots and welds. The inwardly-projecting thimbles create undesirable pressure drop, however, in the flow of combustion air along the radial space between the flow sleeve and the liner.

There remains a need, therefore, for a technique for cooling localized hot spots and/or welds that provides increased durability but less pressure drop, and without negatively impacting cooling efficiency.

BRIEF DESCRIPTION OF THE INVENTION

In one exemplary but nonlimiting aspect, the invention relates to a gas turbine combustor comprising: a combustor liner having a forward end and an aft end; a flow sleeve surrounding the combustor liner, the flow sleeve also having forward and aft ends, the aft end of the flow sleeve supporting an annular ring formed with a plurality of cooling bores that extend through the ring and the flow sleeve, at least some of the plurality of cooling bores formed at an acute angle relative to a longitudinal axis of the combustor liner.

In another exemplary aspect, a turbine combustor component cooling arrangement comprising: a first combustor component to be cooled; a second combustor component at least partially surrounding the first component with an annular radial space therebetween, the second combustor component formed with plural bosses on an exterior surface thereof; a cooling bore formed in each the boss, extending through the second combustor component at an acute angle to a longitudinal axis through the first combustor component so as to direct cooling air to a target area on the first combustor component, and wherein the bosses are provided on an annular ring on the exterior surface of the second combustor component, such that outlets of the cooling bores are flush with an interior surface of the second combustor component.

In still another exemplary aspect, the invention relates to A method of cooling a first turbine combustor component surrounded by a second combustor component with a radial flow passage therebetween, comprising: (a) providing a ring on an exterior surface of the second combustor component in substantial radial and axial alignment with a target area to be cooled on the first combustor component; (b) forming bores through the ring and the second combustor component at an acute angle to a longitudinal center axis of the second combustor component, adapted to direct cooling air to the target area, wherein outlets to the bores are flush with an interior surface of the second combustor component to thereby minimize pressure drop in flow through the flow passage.

An exemplary but nonlimiting embodiment of the invention will now be described in detail in connection with the drawings identified below.

DETAILED DESCRIPTION OF THE INVENTION

Figure 1:
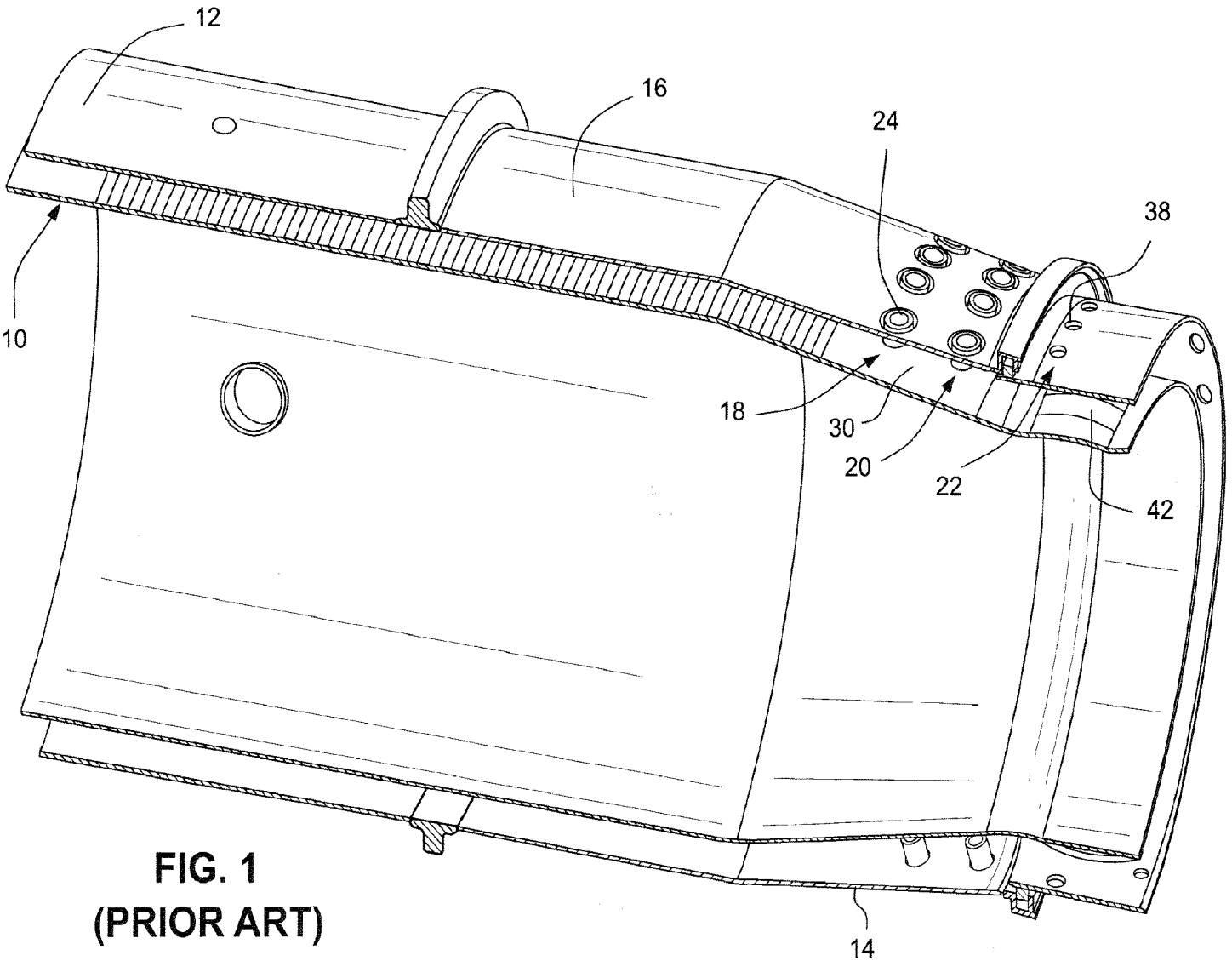
FIG. 1 (PRIOR ART)
FIG. 1 is a perspective view, partially cut away, of a conventional gas turbine combustor liner.
Figure 3:
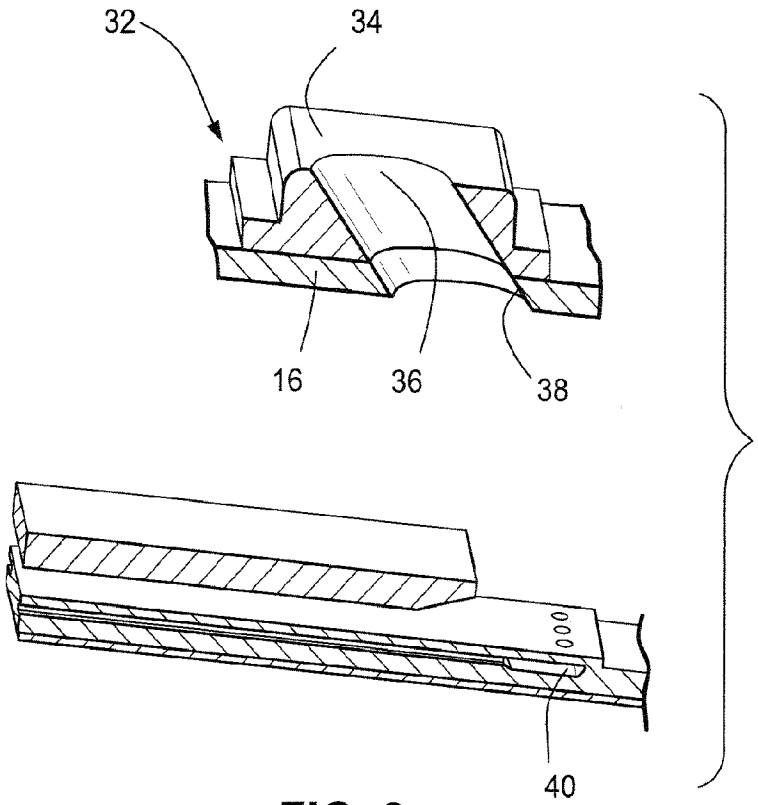
FIG. 3 is a partial perspective view of a directional cooling ring in accordance with an exemplary but nonlimiting embodiment of the invention.
Figure 2:
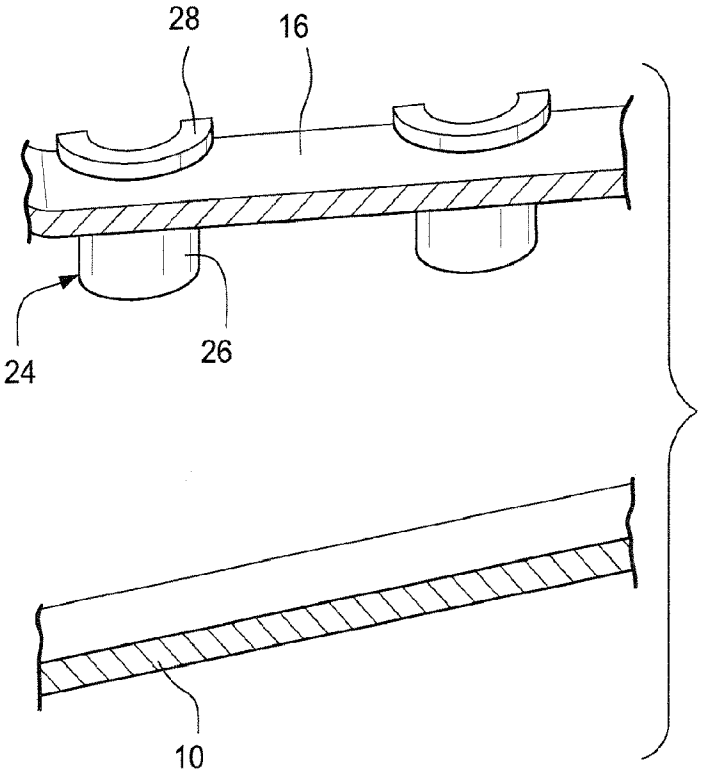
FIG. 2 (PRIOR ART)
FIG. 2 is a partial perspective view of a conventional thimble arrangement in a combustor flow sleeve in proximity to a combustor liner.

With reference now to FIGS. 1 and 2, a conventional turbine combustor liner 10 includes a generally cylindrical, segmented body having a forward end 12 and an aft end 14. The forward end 12 is typically closed by liner cap hardware (not shown) that also mounts one or more fuel injection nozzles for supplying fuel to the combustion chamber within the liner. The opposite or aft end of the liner is typically secured to a tubular transition piece (not shown) that supplies the hot combustion gases to the first stage of the turbine. The invention is not limited, however, to liners as illustrated in FIG. 1, or to use in a combustor liner. The invention described below is applicable to any hot gas path combustor component where cooling air is required.

In a typical known arrangement, a plurality of axially-spaced, circumferential rows of air dilution or air mixing holes are formed in the surrounding flow sleeve 16 toward the aft end 14 of the liner, i.e., closer to the transition piece, at the downstream end of the liner. Three rows 18, 20 and 22 of air dilution or air mixing holes are shown, but the number of rows, and the number of holes in each row, may vary.

Thimbles 24 are shown in rows 18 and 20, but not in row 22. Each thimble 24 includes a substantially cylindrical wall 26 defining a center opening for supplying air to the interior of the liner or other component with a flange 28 engaged with the outer surface of the flow sleeve. Thus, the hole defined by the thimble wall 26 is adapted to supply air to the liner in lieu of a hole in which it is inserted.

The illustration of thimbles 24 is merely by way of background, noting that the thimbles project into the annular space 30 between the liner and the flow sleeve, bringing the cooling air closer to the liner surface, but also producing undesirable pressure drop in the axial flow of air within the radial space 30 between the flow sleeve and the liner.

In the exemplary but nonlimiting embodiment, a ring or band 32 is provided with upstanding bosses 34 at locations where cooling holes 36 are formed. The ring or band 32 extends about the flow sleeve 16, overlying a row of cooling holes (for, example, row 22). Cooling holes or bores 36 are aligned with the cooling holes 38 in the flow sleeve, and at least some if not all of the bores 36 are drilled or otherwise formed at an acute angle relative to the longitudinal axis of the liner. In addition, because the ring or band 32 and more significantly, the bosses 34 project radially away from the flow sleeve, there is nothing projecting into the annular space 30 between the flow sleeve 16 and the liner 10, so that pressure drop in that space is minimized. Note that in this regard that the outlets to holes 38 are flush with the inside surface of the flow sleeve. At the same time, the thickness of the ring or flange 32 and bosses 34 permit implementation of the directionality feature of the cooling jets exiting the bores 36. The ring or band 32 may be fixed to the flow sleeve by welding or other suitable means (especially in a retro-fit application), or may be formed integrally with the flow sleeve 16. The ring or band 32 may be applied to any or all rows 18, 20, 22, etc., of cooling and the angle of the bores 36 may be uniform throughout, or may vary as needed, individually or by row, to achieve any desired directional cooling result. In this regard, cooling bore angles may be uniform throughout a row, or may vary within the row, depending on the designated target area (s).

In the illustrated embodiment, with the ring or band 32 overlying, for example, the holes 38 in row 22. This row is of particular exemplary interest in that it lies generally radially and axially adjacent a location where aft liner sections are welded together (see weld 40) and where a seal comprising an annular array of springs (also known as a hula seal, see seal 42 in FIG. 1) are fixed to the liner for sealing engagement with a transition piece inserted into the space between the seals and the flow sleeve. The weld 40 and/or seal 42 may thus be considered the target area in this example. The cooling technique described herein, however, may be used in various other applications where directional cooling is desired.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A gas turbine combustor comprising: a combustor liner having a forward end and an aft end; a flow sleeve surrounding said combustor liner, said flow sleeve also having forward and aft ends substantially radially adjacent the forward and aft ends, respectively, of said combustor liner, the aft end of the combustor liner connected to a transition piece adapted to supply hot combustion gases to a turbine, the aft end of the flow sleeve supporting an external annular ring welded to or integral with said flow sleeve and formed with plurality of outward projecting bosses; a plurality of cooling bores extending substantially radially through said bosses, said annular ring and said flow sleeve, opening into an annular space radially between the flow sleeve and the combustor liner, at least some of said plurality of cooling bores formed at an acute angle relative to a longitudinal axis of said combustor liner to thereby direct cooling air in a substantially radial direction to a target area on said combustor liner.

2. The gas turbine combustor of claim 1 wherein said target area on said combustor liner includes an annular weld and wherein said plurality of cooling bores are angled so as to cause impingement of cooling flow exiting said bores on said weld.

3. The gas turbine combustor of claim 2 wherein said annular weld lies axially adjacent an annular spring seal, said plurality of cooling bores also directing cooling flow onto said spring seal.

4. The gas turbine combustor of claim 1 wherein one or more rows cooling holes lie axially adjacent said annular ring.

5. The gas turbine combustor of claim 1 wherein all of said plurality of cooling bores are formed at said acute angle.

6. The gas turbine combustor of claim 1 wherein other of said plurality of cooling bores are formed at a different acute angle.

7. A turbine combustor component cooling arrangement comprising:

a first combustor component to be cooled;

a second combustor component surrounding said first component and extending substantially between forward and aft ends of said first combustor component with an annular radial space therebetween, said second combustor component formed with plural upstanding bosses on an exterior surface on an aft end thereof; a cooling bore extending substantially radially through said plural upstanding bosses and said second combustor component at an acute angle to a longitudinal axis through said first combustor component so as to direct cooling air substantially radially toward a target area on and aft end of said first combustor component, wherein a third combustor component is adapted to join with said aft end of said first combustor component, and further wherein said upstanding bosses are provided on an annular ring welded to or integral with said exterior surface of said second combustor component, such that outlets of said cooling bores flush with an interior surface of said second combustor component.

8. The turbine combustor cooling arrangement of claim 7 wherein said first combustor component comprises a combustor liner and said second component comprises a flow sleeve.

9. The turbine combustor cooling arrangement of claim 7 wherein said target area comprises an annular weld on said first combustor component.

10. The turbine combustor cooling arrangement of claim 7 wherein said target area comprises an annular seal on said first combustor component.

11. The turbine combustor cooling arrangement of claim 7 wherein one or more rows cooling holes lie axially adjacent said annular ring.

12. A method of cooling a turbine combustor liner surrounded along substantially its entire length by a flow sleeve with a radial flow passage therebetween, comprising:

(a) providing a ring on an exterior surface of and aft end of said flow sleeve in substantial radial and axial alignment with a target area to be cooled at an aft end of said combustor liner, said ring projecting radially away from said flow sleeve and provided with a plurality of upstanding bosses;

(b) forming bores extending substantially radially through said plurality of upstanding bosses, said ring and said flow sleeve at an acute angle to a longitudinal center axis of said flow sleeve, adapted to direct cooling air substantially radially to the target area, wherein outlets to said bores are flush with an interior surface of said flow sleeve to thereby minimize pressure drop in flow through said flow passage.

13. The method of claim 12 wherein said target area comprises an annular weld on said combustor liner.

14. The method of claim 12 wherein said target area comprises an annular seal on said combustor liner.

15. The method of claim 12 wherein said acute angle is uniform for all said bores.

16. The method of claim 12 wherein said acute angle differs for bores in an annular row of bores.

* * * * *